US008908820B1

(12) United States Patent
Reyes et al.

(10) Patent No.: US 8,908,820 B1
(45) Date of Patent: Dec. 9, 2014

(54) STIRLING RADIOISOTOPE GENERATOR AND THERMAL MANAGEMENT SYSTEM

(75) Inventors: Jaime M. Reyes, Phoenixville, PA (US); Meghan Britton, Wayne, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 383 days.

(21) Appl. No.: 13/291,058

(22) Filed: Nov. 7, 2011

Related U.S. Application Data

(60) Provisional application No. 61/411,184, filed on Nov. 8, 2010.

(51) Int. Cl.
*F02G 1/00* (2006.01)

(52) U.S. Cl.
CPC ..... *F02G 1/00* (2013.01)
USPC ..... 376/146; 376/147; 62/6; 165/185

(58) Field of Classification Search
USPC ..... 62/6
See application file for complete search history.

(56) References Cited

U.S. PATENT DOCUMENTS 5,077,637 A * 12/1991 Martorana et al. ..... 361/717
2006/0156741 A1* 7/2006 Kirkconnell et al. ..... 62/6

OTHER PUBLICATIONS

Chan et al., "Development of Advanced Stirling Radioisotope Generator for Space Exploration" May 2007 NASA/TM—2007-214806.*

Lange et al., "Review of recent advances of radioisotope power systems" Jan. 8, 2008 Energy Conversion & Management pp. 393-401.*

Or, Kumar, et al., "Self-Supporting Radioisotope Generators With STC-55W Stirling Converters" Space Technology and Applications International Forum—2000.*

* cited by examiner

*Primary Examiner* — Jack W Keith
*Assistant Examiner* — Sean P Burke
(74) *Attorney, Agent, or Firm* — McDermott Will & Emery LLP

(57) ABSTRACT

A Stirling radioisotope generator is provided. The generator includes a first and second heat source assembly, each heat source assembly comprising two General Purpose Heat Source modules, each General Purpose Heat Source module configured to generate thermal energy. The generator also includes a first and second Stirling convertor in thermal communication with the first and second heat source assembly, respectively, each Stirling convertor configured to convert the thermal energy into electrical power. The generator has a housing enclosing the first and second heat source assembly and the first and second Stirling convertor, the housing configured to dissipate excess thermal energy.

29 Claims, 9 Drawing Sheets

STIRLING RADIOISOTOPE GENERATOR AND THERMAL MANAGEMENT SYSTEM

CROSS-REFERENCES TO RELATED APPLICATIONS

The present application claims the benefit of U.S. Provisional Patent Application Ser. No. 61/411,184, entitled "Modular Stirling Generator and Heat Source Shunt," filed on Nov. 8, 2010, which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable.

FIELD

The present invention generally relates to a Stirling radioisotope generator and, in particular, relates to an extended performance Stirling radioisotope generator and a thermal management system.

BACKGROUND

The flight-proven General Purpose Heat Source Radioisotope Thermoelectric Generator (GPHS-RTG) has a unit power output of about 290 $W_{dc}$ using heat from a radioactive decay of $^{238}Pu$ included in eighteen General Purpose Heat Source (GPHS) modules at the beginning of life (BOL). The GPHS-RTG typically weighs about 56 kg and has a specific power of 5.4 W/kg. With a nominal thermal power for a single GPHS module of 250 $W_{th}$ at BOL, the GPHS-RTG has a system efficiency of 6.7%. Conventionally, the GPHS-RTG powered large space exploration missions launched in the decade of the 1990's (e.g. Ulysses, Galileo, and Cassini) as well as the New Frontier class Pluto-New Horizons mission in 2006.

Since then, space programs (e.g. National Aeronautics and Space Administration (NASA)) have focused efforts on developing smaller Radioisotope Power Systems (RPS) with multi-mission capability, capable of operation in space and in planetary atmosphere environments.

For example, an Advanced Stirling Radioisotope Generator (ASRG) provides high fuel efficiency relative to a comparable Radioisotope Thermoelectric Generator (RTG). Furthermore, due to a limited inventory and future production rate of $^{238}Pu$, there is increased incentive to use the ASRG unit. However, the nominal power output of the ASRG limits its application to lower power uses, (e.g. 140 $W_{dc}$).

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

Various aspects of the subject technology provide an extended performance Stirling radioisotope generator capable of having a nominal power output of 300 $W_{dc}$ or more. In some aspects, the power output of the Stirling radioisotope generator may be increased by increasing the number of General Purpose Heat Source (GPHS) modules per Stirling convertor. Excess thermal energy may be efficiently managed and distributed using a housing, radiator fins, heat spreaders, thermal straps, and/or heat shunt to ensure that the GPHS modules and/or internal components of the Stirling convertor do not exceed their upper temperature limits. In some aspects, by improving a temperature distribution of a generator housing, performance of the generator may be increased. In other aspects, by reducing a mass of the housing, a specific power of the generator may be increased.

In accordance with one aspect of the subject technology, a Stirling radioisotope generator is provided. The generator comprises a first and second heat source assembly, each heat source assembly comprising two General Purpose Heat Source modules, each General Purpose Heat Source module configured to generate thermal energy. The generator also comprises a first and second Stirling convertor in thermal communication with the first and second heat source assembly, respectively, each Stirling convertor configured to convert the thermal energy into electrical power. The generator further comprises a housing enclosing the first and second heat source assembly and the first and second Stirling convertor, the housing configured to dissipate excess thermal energy.

According to another aspect of the subject technology, a Stirling radioisotope generator is provided. The generator comprises a first and second heat source assembly, each heat source assembly comprising three General Purpose Heat Source modules, each General Purpose Heat Source module configured to generate thermal energy. The generator also comprises a first and second Stirling convertor in thermal communication with the first and second heat source assembly, respectively, each Stirling convertor configured to convert the thermal energy into electrical power. The generator further comprises a housing enclosing the first and second heat source assembly and the first and second Stirling convertor; the housing configured to dissipate excess thermal energy.

According to various aspects of the subject technology, a Stirling radioisotope generator is provided. The generator comprises a first and second heat source assembly, each heat source assembly comprising four General Purpose Heat Source modules, each General Purpose Heat Source module configured to generate thermal energy. The generator also comprises a first and second Stirling convertor in thermal communication with the first and second heat source assembly, respectively, each Stirling convertor configured to convert the thermal energy into electrical power. The generator further comprises a housing enclosing the first and second heat source assembly and the first and second Stirling convertor; the housing configured to dissipate excess thermal energy.

According to another aspect of the subject technology, a method for distributing excess thermal energy of a Stirling radioisotope generator is provided. The method comprises distributing the excess thermal energy to an end of a housing using a heat spreader, the housing enclosing a first and second heat source assembly and a first and second Stirling convertor; wherein the first and second heat source assembly each have two or more General Purpose Heat Source modules, each General Purpose Heat Source module configured to generate thermal energy.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology. Like components are labeled with identical element numbers for ease of understanding.

Various aspects of the subject technology provide an extended performance Stirling radioisotope generator capable of having a nominal power output of 300 $W_{dc}$ or more. In some aspects, the power output of the Stirling radioisotope generator may be increased by increasing the number of General Purpose Heat Source (GPHS) modules per Stirling convertor. Excess thermal energy may be efficiently managed and distributed using a housing, radiator fins, heat spreaders, thermal straps, and/or heat shunt to ensure that the GPHS modules and/or internal components of the Stirling convertor do not exceed their upper temperature limits. In some aspects, by improving a temperature distribution of a generator housing, performance of the generator may be increased. In other aspects, by reducing a mass of the housing, a specific power of the generator may be increased.

Figure 1A:
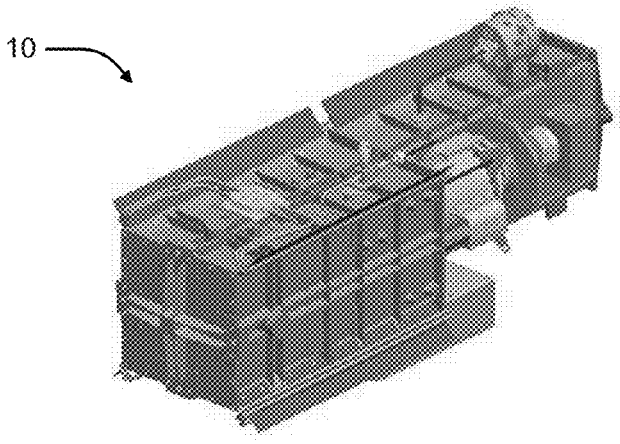
FIG. 1A [Prior Art]
FIGS. 1A-1C illustrate conventional radioisotope power systems.
Figure 1B:
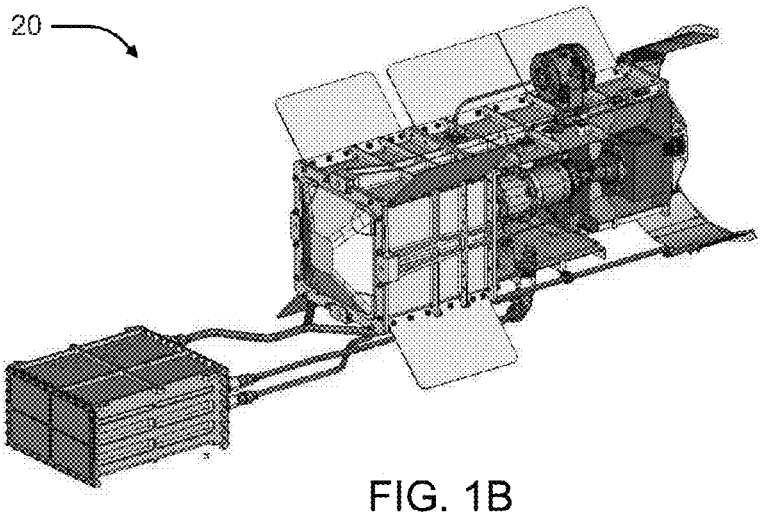
FIG. 1B [Prior Art]

Referring to FIG. 1A, a conventional radioisotope power system for a space vehicle may comprise a Stirling Radioisotope Generator (SRG110) 10. The SRG110 uses two Stirling convertors, each Stirling convertor configured to produce about 65 $W_{ac}$. The power output for the SRG110 is about 110 $W_{dc}$. Referring to FIG. 1B, another conventional radioisotope power system for a space vehicle may comprise an Advance Stirling Convertor (ASRG) 20 that uses two Advanced Stirling convertors, each configured to produce 80 $W_{ac}$. The ASRG evolved from the SRG110 using a more efficient and higher power Stirling convertor, known as the Advanced Stirling Convertor (ASC). The ASRG may also be configured to use a controller that is mounted elsewhere in a space vehicle or spacecraft and away from the ASRG, as shown in FIG. 1B. The ASC converts the heat from one GPHS module to produce about 80 $W_{ac}$. The ASC is also physically smaller than the Stirling convertor of the SRG110. Therefore, the total housing length of the ASRG is shorter than the housing length of the SRG110. The power output for the ASRG is about 140 $W_{dc}$ at the Beginning of Life (BOL) and has a specific power of about 6 $W_{dc}$/kg, twice that of the SRG110.

Figure 1C:
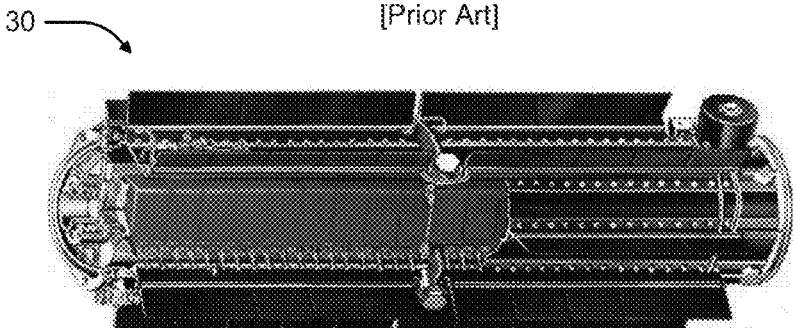
FIG. 1C [Prior Art]

For applications requiring a larger power capacity, such as those requiring about 300 $W_{dc}$, a conventional radioisotope power system for space vehicles may comprise a General Purpose Heat Source Radioisotope Thermoelectric Generator (GPHS-RTG). Referring to FIG. 1C, a GPHS-RTG 30 may have a power output of about 290 $W_{dc}$ using heat from a radioactive decay of $^{238}$Pu included in eighteen GPHS modules at the BOL. The GPHS-RTG typically weighs about 56 kg and has a specific power of 5.4 $W_{dc}$/kg. Due to the limited inventory and future production rate of $^{238}$Pu, however, a more efficient radioisotope power system may be desired.

Figure 2:
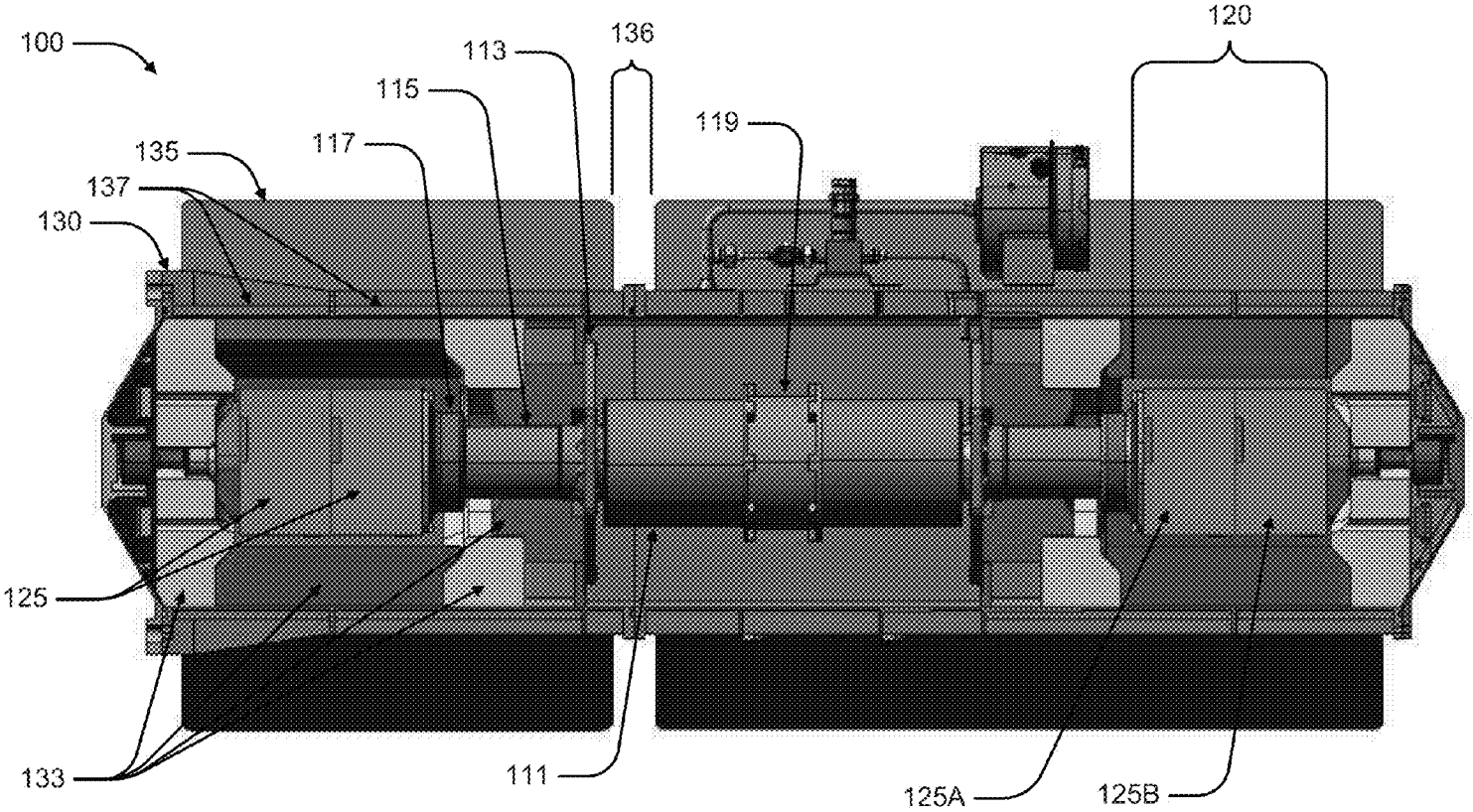
FIG. 2 illustrates a cross sectional view of an extended performance Stirling radioisotope generator, in accordance with various aspects of the subject technology.
Figure 3:
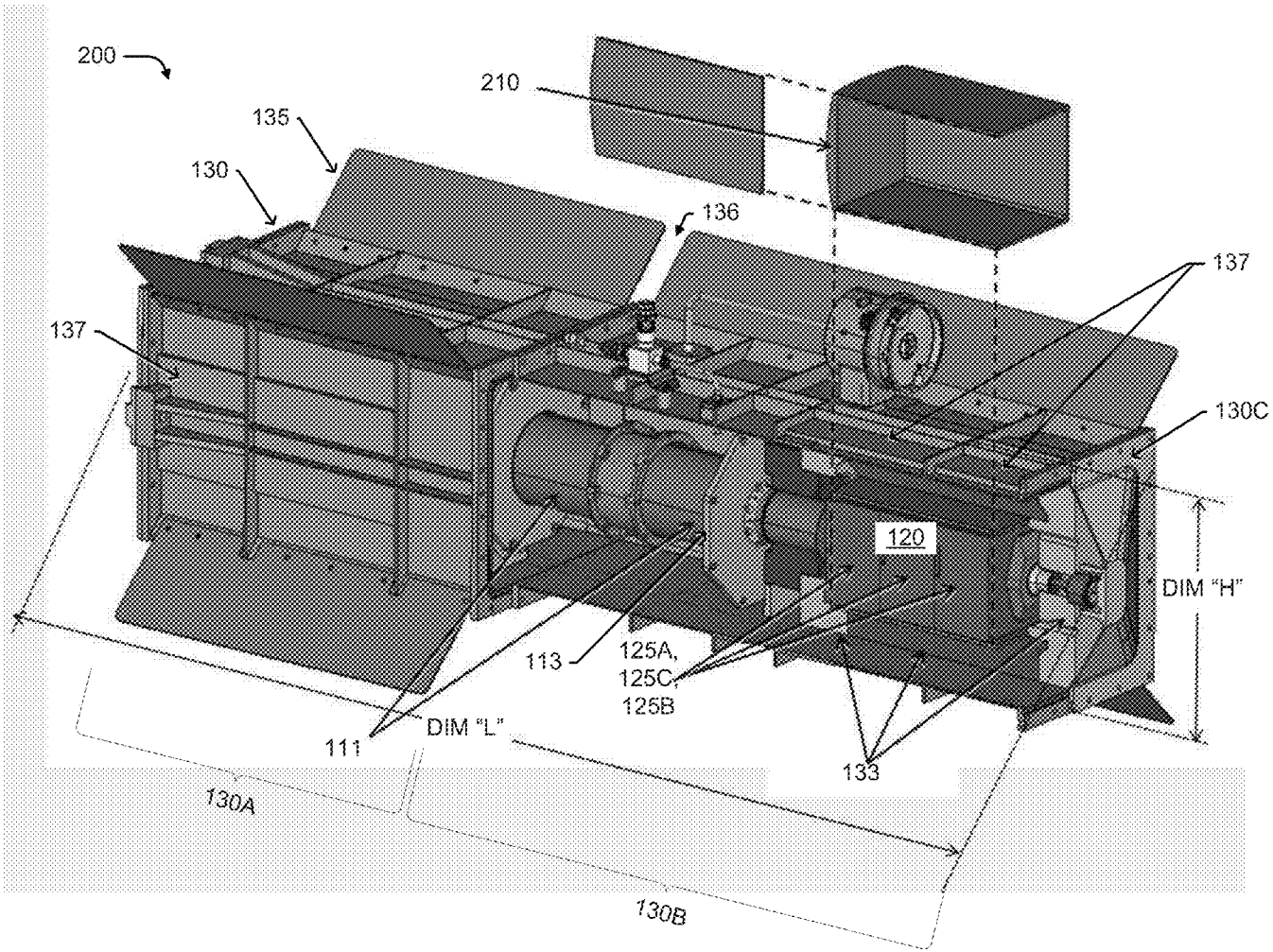
FIG. 3 illustrates an isometric view of an extended performance Stirling radioisotope generator and a heat shunt, in accordance with various aspects of the subject technology.
Figure 4:
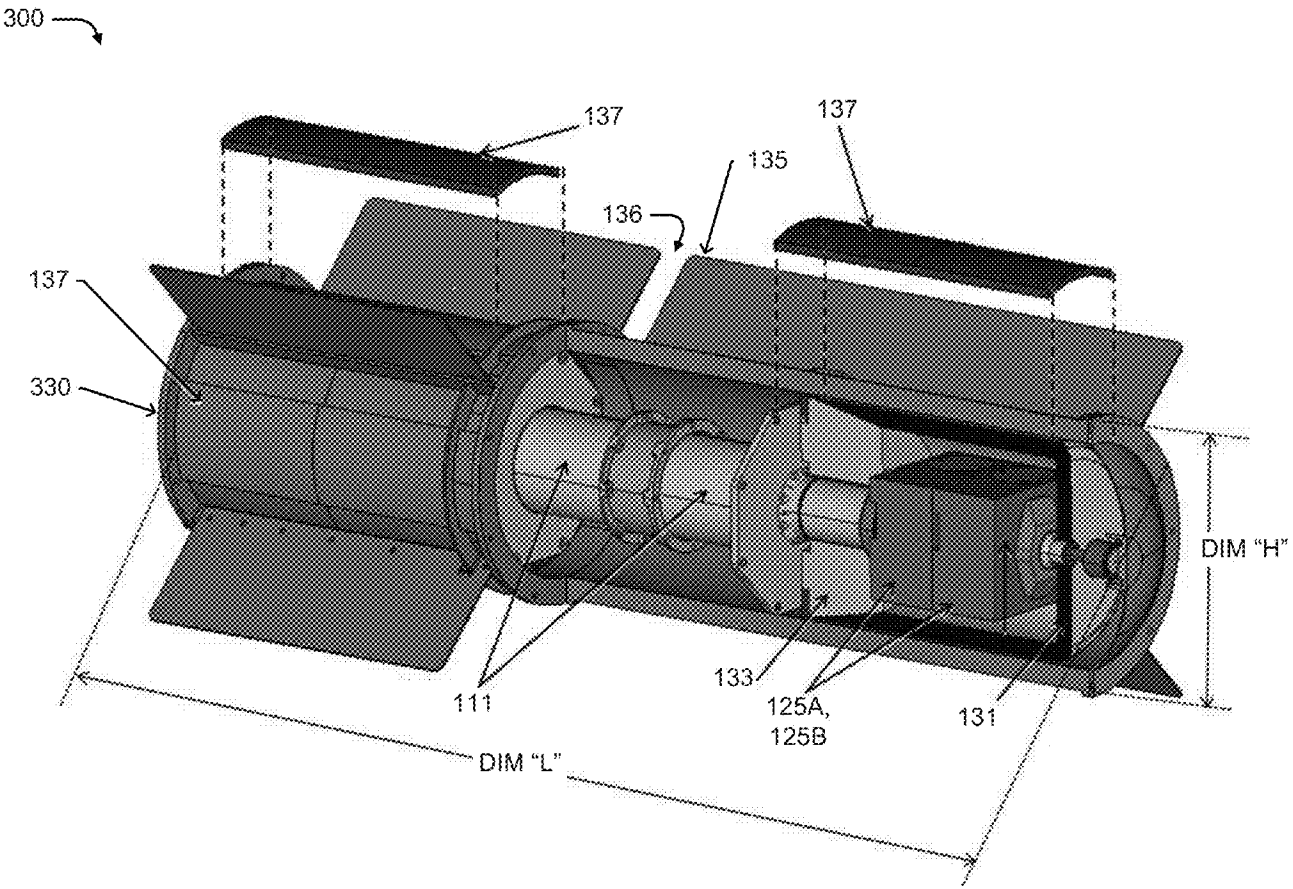
FIG. 4 illustrates an isometric view of an extended performance Stirling radioisotope generator, in accordance with various aspects of the subject technology.
Figure 5:
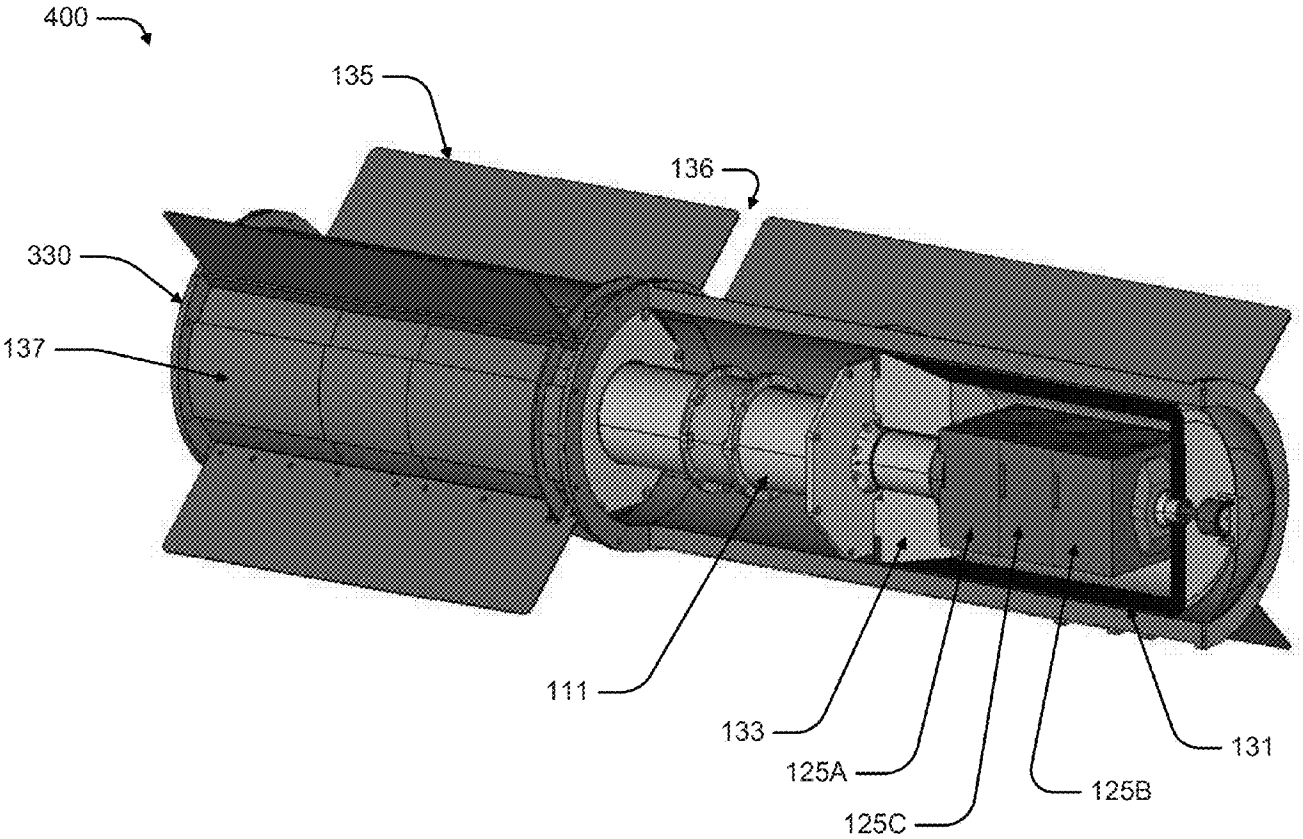
FIG. 5 illustrates an isometric view of an extended performance Stirling radioisotope generator, in accordance with various aspects of the subject technology.
Figure 6:
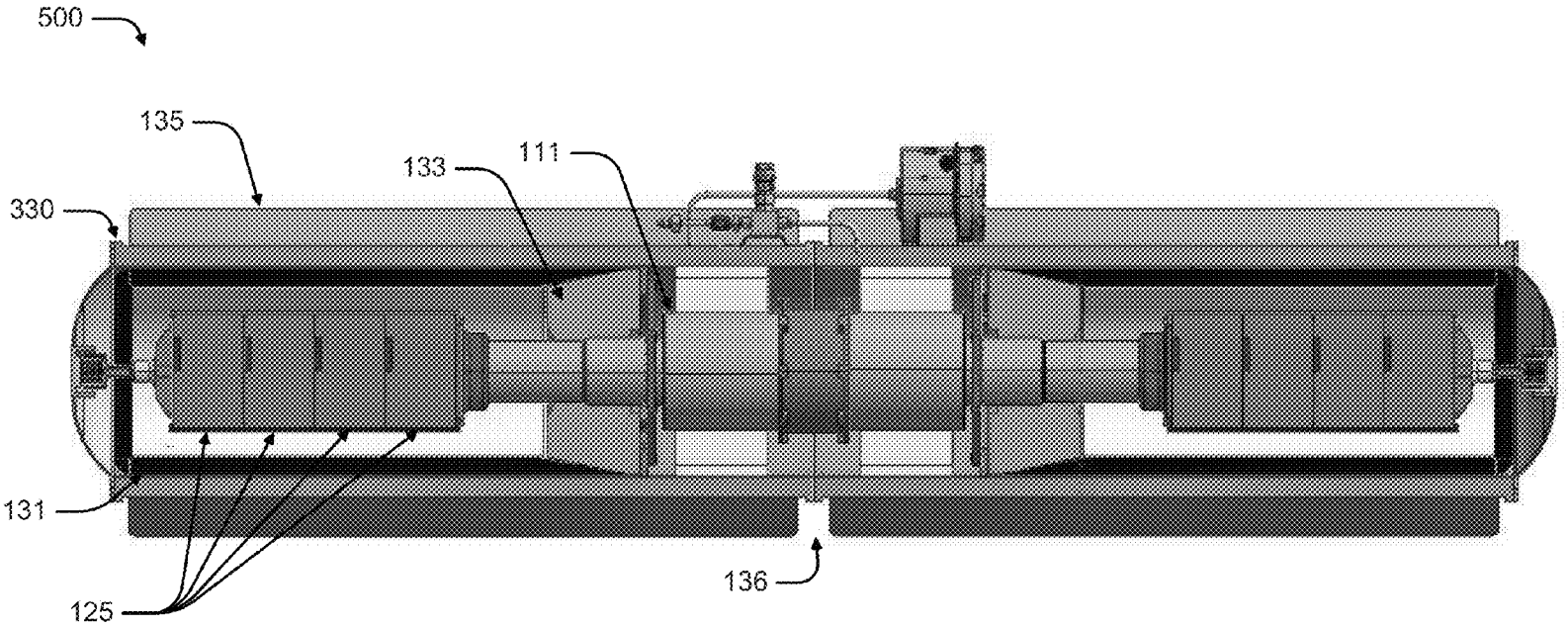
FIG. 6 illustrates a cross sectional view of an extended performance Stirling radioisotope generator, in accordance with various aspects of the subject technology.

Various aspects of the subject technology provide a Stirling radioisotope generator capable of producing a nominal power output of about 300 $W_{dc}$ or more by using a plurality of Stirling converters and a plurality of heat source assemblies. Referring to FIGS. 2 and 4, the extended performance Stirling radioisotope generator 100, 300 may produce a nominal power output of about 300 $W_{dc}$ by using four GPHS modules 125 and two Stirling convertors 111 and may have a specific power greater than 8 $W_{dc}$/kg. Referring to FIGS. 3 and 5, the extended performance Stirling radioisotope generator 200, 400 may produce a nominal power output of about 450 $W_{dc}$ by using six GPHS modules 125 and two Stirling convertors 111 and may have a specific power greater than 8 $W_{dc}$/kg. Referring to FIG. 6, the extended performance Stirling radioisotope generator 500 may produce a nominal power output of about 600 $W_{dc}$ by using eight GPHS modules 125 and two Stirling convertors 111 and may have a specific power of greater than 8 $W_{dc}$/kg.

In some aspects, the generator may include a first and second Stirling convertor 111 disposed in an opposite linear arrangement and configured to be in thermal communication with a first and second heat source assembly 120, respectively. In one aspect, each of the heat source assemblies 120 may be disposed adjacent to opposing ends of the housing 130, 330. Referring to FIGS. 2-6, each heat source assembly 120 may include two or more GPHS modules 125 disposed in a stacked arrangement, and may be configured to provide thermal energy to its respective Stirling convertor 111. It should be understood, however, that the Stirling convertors 111 and heat source assemblies 120 may be disposed in other configurations and/or arrangements.

Stirling Convertor:

According to various aspects of the subject technology, the first and second Stirling convertors 111 may each be configured to convert the thermal energy of the first and second heat source assemblies 120, respectively, into electrical power by thermoelectrics, as known by a person of ordinary skill in the art. For example, referring to FIGS. 2 and 4, the first and second Stirling convertors 111 may each be configured to receive and convert the thermal energy from the two GPHS modules 125 into a nominal power output of about 160 $W_{ac}$. In another example, referring to FIGS. 3 and 5, the first and second Stirling convertors 111 may each be configured to receive and convert the thermal energy from the three GPHS modules 125 into a nominal power output of about 240 $W_{ac}$. In another example, referring to FIG. 6, the first and second Stirling convertors 111 may each be configured to receive and convert the thermal energy from the four GPHS modules 125 into a nominal power output of about 320 $W_{ac}$.

In some aspects, the Stirling convertor 111 may comprise a scaled ASC design that is configured to accommodate the higher amount of thermal energy generated from the additional number of GPHS modules. For example, the ASC may be scaled by increasing a volume of the ASC by changing the length and/or diameter of the ASC. In this example, the Stirling convertor 111 may be longer and have a larger diameter than the ASC. For example, for a scaled Stirling convertor configured for converting the thermal energy from two GPHS modules, the Stirling convertor 111 may be about 9 inches long and have an outer diameter of about 3 inches at its largest cross section.

In some aspects, each Stirling convertor 111 may include a heat collector 117 that is thermally coupled to its respective heat source assembly 120 to draw the thermal energy from the heat source assembly 120 to the Stirling convertor 111 via conduction. The heat collector 117 may be coupled to a heater head 115. The heater head 115 may be coupled to a cold side adaptor flange (CSAF) 113. In some aspects, the CSAF 113 may be configured to transfer the excess thermal energy from the heat source assembly 120 to the housing 130, 330 by conduction, as further described below. The CSAF 113 may also be connected to a bulk head of the housing 130, 330 for structural support. The Stirling convertor 111 may also include a vessel with an alternator housed therein, the alternator configured to generate the alternating current. Generally, the alternator may have an upper operating temperature limit of 130° C. In one aspect, the first and second Stirling convertors 111 are attached to each other using an interconnect sleeve 119 that is configured to align each of the Stirling convertors 111 with respect to the housing 130, 330 and/or GPHS modules 125.

According to one aspect, because the space vehicle may require electrical power to be in direct current, a controller may be utilized to convert the electrical power generated by the Stirling convertor 111 from alternating current into direct current. Accordingly, in this example, the generator 100, 200, 300, 400, 500 would have a power output in direct current. The controller may be disposed remote from the generator 100, 200, 300, 400, 500 and be located elsewhere in the space vehicle. Efficiency of the controller in converting the power from alternating current to direct current may be about 91%.

GPHS Module:

In various aspects, each heat source assembly 120 may comprise a plurality of GPHS modules 125 that are configured to generate thermal energy. Referring to FIGS. 2 and 4, each of the first and second heat source assemblies 120 may include two GPHS modules 125 that are each configured to generate about 250 $W_{th}$ at the BOL. Referring to FIGS. 3 and 5, each of the first and second heat source assemblies 120 may include three GPHS modules 125 that are each configured to generate about 250 $W_{th}$ at the BOL. Referring to FIG. 6, each of the first and second heat source assemblies 120 may include four GPHS modules 125 that are each configured to generate about 250 $W_{th}$ at the BOL.

In some aspects, each GPHS module 125 may include pelletized $^{238}Pu$ encapsulated in an iridium cladding forming a fueled clad (not shown). Fueled clads are encased within a plurality of nested layers of carbon based material and placed within an aeroshell housing, as known by those of ordinary skill in the art.

In one aspect, the GPHS modules 125 of each heat source assembly 120 may be disposed between an inboard and outboard pressure plate. The inboard pressure plate may be configured to engage the heat collector 117 of the Stirling convertor 111. The outboard pressure plate may be configured to engage a preload stud that in turn compresses the GPHS modules 125 of each heat source assembly 120, as known by those of ordinary skill in the art.

In some aspects, the GPHS modules 125 are substantially similar to the GPHS modules of the conventional ASRG 20 and have a substantially similar cross section. Generally, an upper temperature limit for the GPHS modules 125 may be about 1300° C. or 1270° C. Referring to FIGS. 2 and 4, the four GPHS modules 125 of the generator 100, 300 may have an average temperature below the upper temperature limit of the GPHS modules, as shown in Table 1:

TABLE 1

| Heat Source Assembly | GPHS Module Location | Average Temperature |
|---|---|---|
| First Heat Source Assembly | Outboard | 1240° C. |
| First Heat Source Assembly | Inboard | 1180° C. |
| Second Heat Source Assembly | Outboard | 1240° C. |
| Second Heat Source Assembly | Inboard | 1180° C. |

In some aspects, the outboard GPHS modules 125B may have a higher temperature than the inboard GPHS modules 125A because the thermal energy is drawn by the Stirling convertor 111 through the inboard GPHS modules 125A. Accordingly, because the outboard GPHS module 125B is further away from the Stirling convertor 111 and not in direct contact with the Stirling convertor 111, the average temperature of the outboard GPHS module 125B may be higher than the inboard GPHS module 125A.

Referring to FIGS. 3 and 5, the six GPHS modules 125 of the generator 200, 400 may be arranged such that each of the first and second heat source assemblies 120 includes three GPHS modules 125. In some aspects, because the number of GPHS modules 125 is greater than two per Stirling convertor 111, a heat shunt 210 may be used to maintain an average temperature of the GPHS modules 125 that is below the upper temperature limit of the GPHS modules 125, as shown in Table 2. Accordingly, the heat shunt 210 may reduce the average temperature of the outboard and/or middle GPHS modules, 125B and 125C respectively, to a temperature below the upper temperature limit for the GPHS modules 125.

TABLE 2

| Heat Source Assembly | GPHS Module Location | Average Temperature Without Heat Shunt | Average Temperature With Heat Shunt |
|---|---|---|---|
| First Heat Source Assembly | Outboard | 1300° C. | 1250° C. |
| First Heat Source Assembly | Middle | 1280° C. | 1250° C. |
| First Heat Source Assembly | Inboard | 1220° C. | 1210° C. |
| Second Heat Source Assembly | Outboard | 1320° C. | 1270° C. |
| Second Heat Source Assembly | Middle | 1290° C. | 1260° C. |
| Second Heat Source Assembly | Inboard | 1220° C. | 1220° C. |

The heat shunt 210 may be configured to facilitate heat transfer of the thermal energy from the GPHS modules 125 to the heat collector 117 of the Stirling convertor 111. Accordingly, the heat shunt 210 may increase the heat transfer of the thermal energy to the heat collector 117. For example, the heat shunt 210 may be configured to be in thermal communication with one or all of the GPHS modules 125 and the heat collector 117 via conduction. The heat shunt 210 may be integrated with the heat collector 117. In this example, the heat shunt 210 may engage a pressure plate of the heat collector 117.

In another aspect, the heat shunt 210 may be configured to be in thermal communication with a portion of the outboard GPHS module 125B, middle GPHS module 125C, and/or inboard GPHS module 125A to facilitate heat transfer of the thermal energy to the Stirling convertor 111. In yet another aspect, the heat shunt 210 may be configured to surround the heat source assembly 120 to facilitate heat transfer of the thermal energy to the Stirling convertor 111. For example, the heat shunt 210 may be configured to facilitate heat transfer of the thermal energy from the outboard GPHS module 125B to the heat collector 117 of the Stirling convertor 111 by providing a thermal path for the thermal energy via conduction. Accordingly, the heat shunt 210 may provide an alternate thermal path for the thermal energy of the outboard GPHS module 125B, other than through the inboard and middle GPHS modules, 125A and 125C respectively.

In some aspects, the heat shunt 210 may comprise an open box structure made of annealed pyrolytic graphite (APG), or other high thermal conductance material, such as Beryllium or materials having a range of conductivity of about 100-1700 W/m° K, that is configured to surround the heat source assembly 120. In one aspect, the heat shunt 210 may comprise strips of thermally conductive material. In another aspect, the heat shunt 210 may comprise high conductive and high temperature thermal interface materials, such as a high conducting carbon-graphite composite, that is disposed between each of the GPHS modules 125 and between the inboard GPHS module 125A and the Stirling convertor 111, to minimize a temperature gradient across the interfaces.

According to various aspects of the subject technology, an insulating material 133 may be used to insulate the GPHS modules 125 from the housing 130 and thereby prevent loss of the thermal energy generated by the GPHS modules 125. The insulating material 133 may, for example, include Microtherm® insulation manufactured by Microtherm, Inc or other micro-porous insulation. The insulating material 133 may be disposed around the GPHS modules 125 and/or the heat source assemblies 120, as known by those of ordinary skill in the art. In some aspects, the insulating material 133 may comprise multiple components for ease of installation, such as end caps configured to surround the ends of the heat source assembly 120 and a middle portion configured to surround the center region of the heat source assembly 120. In some aspects, the insulating material 133 may also be configured to insulate the heater head 115 of the Stirling convertor 111, as known by those of ordinary skill in the art.

Housing:

According to various aspects of the subject technology, the generator 100, 200, 300, 400, 500 may include a housing 130, 330 for enclosing the plurality of Stirling converters 111 and the plurality of heat source assemblies 120. Referring to FIGS. 2-6, the first and second Stirling convertors 111 and the first and second heat source assemblies 120 may be enclosed and protected by the housing 130, 330. Referring to FIG. 3, in some aspects, the housing 130 may include an inboard portion 130A an outboard portion 130B, and covers 130C. The inboard portion 130A may be disposed adjacent the space vehicle (not shown) and the outboard portion 130B may extend laterally or radially outwardly from an outer surface of the space vehicle, similar to the conventional ASRG 20. The inboard and outboard portions, 130A and 130B respectively, may have different or substantially similar lengths and/or ratios.

In some aspects, referring to FIGS. 2-6, the housing 130, 330 may be substantially rectangular or round in cross section. It should be understood, however, that the housing may have other cross sections, such as an oval, hexagonal, or octagonal cross section.

In one aspect, referring to FIGS. 2 and 3, the cross section of the housing 130 may be substantially similar to a cross section of a housing for the conventional ASRG 20 to enable modular interchange between components, a particular application, or a space vehicle. The thickness of the housing 130 (including a plurality of support ribs) may also be substantially similar to the ASRG 20. However, the length of the housing 130 (denoted as DIM "L" in FIG. 3) may be longer than the ASRG 20 because of the increased number of GPHS modules 125 in the generator 100. For example, referring to FIG. 2, to accommodate for the increased length of the Stirling convertor 111 and/or the additional GPHS modules 125, the length (L) of the housing 130 may be about 34 inches, 6 inches more than a typical housing length of the ASRG 20 (e.g. 28 inches).

In another example, referring to FIG. 4, the housing 330 of the generator 300, enclosing two GPHS modules 125 and two Stirling convertors 111, may have a total length (L) of about 34 inches. Referring to FIGS. 3 and 5, the housing 130, 330 of the generator 200, 400 enclosing six GPHS modules 125 and two Stirling convertors 111, may have a total length (L) of about 39 inches. Referring to FIG. 6, the housing 330 of the generator 500, enclosing eight GPHS modules 125 and two Stirling convertors 111, may have a total length (L) of about 49 inches.

In some aspects, the increased mass of the housing caused by its increased length may be minimized by stacking the additional GPHS modules 125 outboard of the heat source assemblies 120, thereby maintaining a dimensional cross-section of the housing 130, 330.

In various aspects of the subject technology, to reduce a mass of the longer housing 130, 330, a Multi-Layer Insulation (MLI) may be used in place of the insulating material 133 to reduce the cross section of the housing 130, 330. In one aspect, because the MLI 131 may be thinner than the insulating material 133, disposing the MLI 131 around the GPHS modules 125 reduces a volume that would otherwise be occupied by the insulating material 133. Accordingly, by using the thinner MLI 131, the housing may be reduced to a smaller cross section thereby reducing the mass of the housing 130. For example, referring to FIGS. 4-6, by using the MLI 131, the housing 330 may have a reduced cross section in comparison to the housing 130 of FIGS. 2 and 3. In this example, the housing 130 may have a height (denoted as DIM "H") of about 8.8 inches. The housing 330, however, may have a diameter (H) of 6.9 inches. Accordingly, the cross section of the housing 330 is smaller than the cross section of the housing 130.

In some aspects, the MLI 131 may comprise a cylindrically-shaped structure configured to surround the GPHS modules 125 and thereby prevent loss of the thermal energy generated by the GPHS modules 125. The MLI 131 may further comprise an end cap configured to cover an outboard end of the heat source assembly 120. In one aspect, the MLI 131 may comprise alternating layers of reflective foil and insulation. For example, the reflective foil may comprise Nickel or Aluminum foil and the insulation may comprise glass fibers or glass cloth, as known by those of ordinary skill in the art.

In some aspects, by using MLI 131 and thereby reducing the mass of the housing 330, the specific power for the generator 300, 400, 500 may be increased. Specific power is calculated by dividing the nominal power output of the generator by its mass. Therefore, for a given nominal power output, a reduction of the mass of the generator, increases the specific power for the generator.

In various aspects of the subject technology, referring to FIGS. 2-6, the housing 130, 330 may be configured to manage, distribute, and dissipate excess thermal energy from the heat source assemblies 120 and/or the Stirling convertors 111. The housing 130, 330 may be formed from a material having a high thermal conductance, such as Beryllium. The housing 130, 330 formed of Beryllium may have a structural strength suitable for protecting and securing the enclosed components.

In some aspects, because of its lower toxicity and cost in comparison to Beryllium, the housing 130, 330 may be formed of Aluminum. To maintain a structural integrity of the housing 130, 330, however, the thickness of the housing 130, 330 may be increased, thereby increasing the mass of the housing 130, 330. The increased wall thickness may, for example, be about 17% larger than a wall thickness of a housing formed from Beryllium.

In some aspects, the CSAF 113 of the Stirling convertor 111 is configured to transfer the excess thermal energy from the GPHS modules 125 and/or the Stirling convertor 111 to the housing 130, 330. The CSAF 113 may transfer the excess thermal energy by conduction, via physical contact with a bulkhead of the housing 130, 330.

For the conventional ASRG 20, the excess thermal energy that is transferred from the CSAF to the housing may be about 180 W. For the generator 100, 300 having two GPHS modules 125 per Stirling convertor 111, the excess thermal energy may be about 340 W. For the generator 200, 400 having three GPHS modules per Stirling convertor, the excess thermal energy may be about 510 W. For the generator 500 having four GPHS modules per Stirling convertor, the excess thermal energy may be about 680 W. In some aspects, to increase the distribution of the excess thermal energy throughout the housing 130, 330 the generator 100, 200, 300, 400, 500 may include a plurality of radiator fins 135 and/or a plurality of heat spreaders 137, as further discussed below.

In one aspect, the housing 130, 330 may be coated with a high emissivity coating to increase the radiant heat transfer of the excess thermal energy from the housing 130, 330 and thus improve dissipation of the excess thermal energy from the housing 130, 330. The coating may comprise a high emissivity coating for space applications as known by those or ordinary skill in the art.

Radiator Fins and Heat Spreaders:

Referring to FIGS. 2-6, in some aspects, the generator 100, 200, 300, 400, 500 may include a plurality of radiator fins 135 that are configured to facilitate the distribution and dissipation of the excess thermal energy. Each of the plurality of radiator fins 135 may be generally planar in shape and be disposed along a juncture of adjacent sidewalls defining the housing 130. In some aspects, a radiator fin 135 may have one or more slits 136 in the fins to accommodate a structure of the housing 130, 330. Although four radiator fins 135 are shown in FIGS. 2-6, it should be understood that any number of the radiator fins 135 may be used to distribute and dissipate the excess thermal energy. It is further understood that the plurality of radiator fins 135 may have any shape and size suitable for distribution and dissipation of the excess thermal energy.

For example, the plurality of radiator fins 135 may be disposed along a portion of or along the entire length of the housing 130, 330 and have a width of sufficient size to dissipate the excess thermal energy. For example, for the generator 100, 300 having four GPHS modules 125, each of the plurality of radiator fins 135 may have a width of about 6 inches. In some aspects, as the amount of excess thermal energy increases with the additional number of GPHS modules 125, a width and/or thickness of the plurality of radiator fins 135 may also increase, thereby increasing a surface area of the plurality of radiator fins 135 to enable effective dissipation of the increased amount of the excess thermal energy. For example, referring to FIGS. 3 and 5, for the generator 200, 400 having six GPHS modules 125, each of the plurality of radiator fins 135 may have a width of about 8 inches. In another example, referring to FIG. 6, for the generator 500 having eight GPHS modules 125, each of the plurality of radiator fins 135 may have a width of about 10 inches.

The plurality of radiator fins 135 may be formed from a material having a high thermal conductance, such as Beryllium. In some aspects, as the amount of excess thermal energy increases with the additional number of GPHS modules 125, a material with a higher thermal conductivity may be used to enable effective dissipation of the increased amount of the excess thermal energy without increasing a width and/or thickness of the plurality of radiator fins 135. For example, the plurality of radiator fins 135 may be formed from annealed pyrolytic graphite (APG). Although APG may be used to distribute the excess thermal energy uniformly to the extremities or edges of the plurality of radiator fins 135, it should be understood that other materials with high thermal conductance may be used, such as materials having a range of conductivity of about 100-1700 W/m° K.

Referring to FIG. 8*a*, a temperature distribution of an extended performance Stirling radioisotope generator 810 is illustrated. Generator 810 is configured with two GPHS modules per Stirling convertor. The housing 130 and the plurality of radiator fins 135 are formed from Beryllium. As illustrated in FIG. 8*a*, the excess thermal energy from the GPHS modules and/or the Stirling convertor may not be uniformly distributed throughout the housing 130, as indicated by the high temperature gradient surrounding an interface area 815, defined as the area adjacent to the CSAF 113 (not shown) on the surface of the housing 130 that receives the excess thermal energy from the CSAF 113. Consequently, the housing 130 and the plurality of radiator fins 135 may be dissipating the excess thermal energy ineffectively. The average temperature of the heat collector 117 (not shown), CSAF 113 (not shown), alternator (not shown), housing 130, plurality of radiator fins 135, and controller (not shown) for the generator 810 of FIG. 8*a*, are provided in Table 3:

TABLE 3

| Component | Average Temperature |
|---|---|
| Heat Collector | 798° C. |
| Cold Side Adaptor Flange | 128° C. |
| Alternator | 137° C. |
| Housing | 56° C. |
| Radiator Fins | 34° C. |
| Controller | 36° C. |

Because the alternator may have an upper operating temperature limit of 130° C., the average temperature of the alternator for the generator 810 should be reduced to a temperature that is below the upper operating temperature limit.

In some aspects, referring to FIG. 8*b*, the temperature distribution and dissipation of the excess thermal energy for the housing 130 of the generator 810 may be improved and the temperature of the alternator may be reduced, by using a plurality of heat spreaders 137. The plurality of heat spreaders 137 may be configured to facilitate distribution of the excess thermal energy throughout the housing 130. Although a plurality of heat spreaders 137 are shown in FIGS. 2-6, it should be understood that at least one heat spreader 137 may be disposed adjacent to at least one surface of the housing 130, 330 to facilitate distribution of the excess thermal energy throughout the housing 130, 330. In some aspects, the heat spreader 137 may be thermally coupled to the housing 130, 330.

Referring to FIGS. 2 and 3, the plurality of heat spreaders 137 may comprise planar bodies formed of a high thermal conductance material, such as Beryllium, APG, Aluminum, or materials having a range of conductivity of about 100-1700 W/m° K. The plurality of heat spreaders 137 may be disposed on each side of the housing 130, and span from an interface area defined as an area on the housing 130 that is adjacent to the CSAF 113, to an area adjacent to an end of the housing 130. For example, referring to FIG. 2, the heat spreaders 137 may have a length of about 11 inches, thereby allowing the heat spreaders 137 to span from the interface area to the end of the housing 130. The plurality of heat spreaders 137 thereby transfer the excess thermal energy via conduction, to the ends of the housing 130. Accordingly, the plurality of heat spreaders 137 transfer the excess thermal energy in a direction that is outward or outboard of the interface area.

In some aspects, the plurality of heat spreaders 137 may be disposed on an external or internal surface of the housing 130. Although the heat spreader 137 shown in FIGS. 2 and 3 are in the form of a rectangular shaped body, it should be understood that the heat spreader 137 may have any shape and size suitable for distribution and dissipation of the excess thermal energy. For example, referring to FIGS. 4-6, the plurality of heat spreaders 137 may have a curvature to enable sufficient contact between the housing 330 and the heat spreader 137 to distribute the excess thermal energy throughout the housing 330. In this example, the plurality of heat spreaders 137 may be disposed on each quadrant of the housing 330 and span from an interface area defined as an area on the housing 330 that is adjacent to the CSAF 113, to an area adjacent to an end of the housing 330.

In some aspects, each heat spreader 137 may have a width and thickness that is dependent on the amount of the excess thermal energy to distribute. For example, referring to FIG. 2, the width of the heat spreader 137 may be about 4 inches and the thickness may be about 0.25 inches. It should be understood, however, that the width and thickness may be varied to enable the heat spreader to distribute the excess thermal energy throughout the housing 130.

In some aspects, by using the plurality of heat spreaders 137, the temperature distribution of the housing 130, 330 may be improved without modifying a thickness of the housing 130, 330.

Referring to FIG. 8*b*, a temperature distribution of the generator 810 having a plurality of heat spreaders 137 formed from Beryllium is illustrated. Generator 810 is configured with two GPHS modules per Stirling convertor. The housing 130 and the plurality of radiator fins 135 are formed from Beryllium. As illustrated in FIG. 8*b*, the temperature distribution of the excess thermal energy from the GPHS modules and/or the Stirling convertor may be improved due to the heat spreaders 137, as indicated by the reduced temperature gradient surrounding the interface area 815. Consequently, the housing 130 and the plurality of radiator fins 135 may dissipate the excess thermal energy more effectively. As shown in Table 4, the average temperature of the alternator decreased by 20° C. in comparison of the alternator temperature shown in Table 3, to a temperature below the upper operating temperature limit of the alternator.

TABLE 4

| Component | Average Temperature |
|---|---|
| Heat Collector | 799° C. |
| Cold Side Adaptor Flange | 105° C. |
| Alternator | 117° C. |
| Housing | 53° C. |
| Radiator Fins | 32° C. |
| Controller | 31° C. |

In some aspects, by increasing the thermal conductance of the plurality of heat spreaders 137, the temperature distribution of the excess thermal energy throughout the housing 130 may be further improved and a temperature of the alternator may be further reduced. For example, the plurality of heat spreaders 137 may be formed of APG having a thermal conductivity that may be about a hundred times greater than the thermal conductivity of Beryllium.

Referring to FIG. 8*c*, a temperature distribution of the generator 810 having a plurality of heat spreaders 137 formed from APG is illustrated. Generator 810 is configured with two GPHS modules per Stirling convertor. The housing 130 and the plurality of radiator fins 135 are formed from Beryllium. As illustrated in FIG. 8*c*, the temperature distribution of the excess thermal energy from the GPHS modules and/or the Stirling convertor may be further improved due to the heat spreaders 137 formed of APG, as indicated by the effective removal of the temperature gradient surrounding the interface area 815. Consequently, the housing 130 and the plurality of radiator fins 135 may dissipate the excess thermal energy more effectively. As shown in Table 5, the average temperature of the alternator decreased by 31° C. in comparison of the alternator temperature shown in Table 3.

TABLE 5

| Component | Average Temperature |
|---|---|
| Heat Collector | 798° C. |
| Cold Side Adaptor Flange | 92° C. |
| Alternator | 106° C. |

TABLE 5-continued

| Component | Average Temperature |
|---|---|
| Housing | 49° C. |
| Radiator Fins | 29° C. |
| Controller | 27° C. |

In some aspects, to improve the temperature distribution of the excess energy in the plurality of radiator fins 135, the thermal conductance of the radiator fins 135 may be increased to facilitate a uniform temperature distribution of the excess thermal energy along the radiator fins 135. For example, the plurality of radiator fins 135 may be formed of APG and thereby have a higher thermal conductivity in comparison to radiator fins formed of Beryllium.

Referring to FIG. 8*d*, a temperature distribution of the generator 810 having a plurality radiator fins 135 and heat spreaders 137 formed from APG is illustrated. Generator 810 is configured with two GPHS modules per Stirling convertor. The housing 130 is formed from Beryllium. As illustrated in FIG. 8*d*, the temperature distribution of the excess thermal energy in the plurality of radiator fins 135 may be improved, as indicated by the reduced temperature gradient in the radiator fins 135. Consequently, a larger surface area of the radiator fins 135 may be utilized for effectively dissipating the excess thermal energy. As shown in Table 6, the average temperature of the alternator decreased by 37° C. in comparison of the alternator temperature shown in Table 3.

TABLE 6

| Component | Average Temperature |
|---|---|
| Heat Collector | 798° C. |
| Cold Side Adaptor Flange | 86° C. |
| Alternator | 100° C. |
| Housing | 44° C. |
| Radiator Fins | 33° C. |
| Controller | 24° C. |

Figure 7:
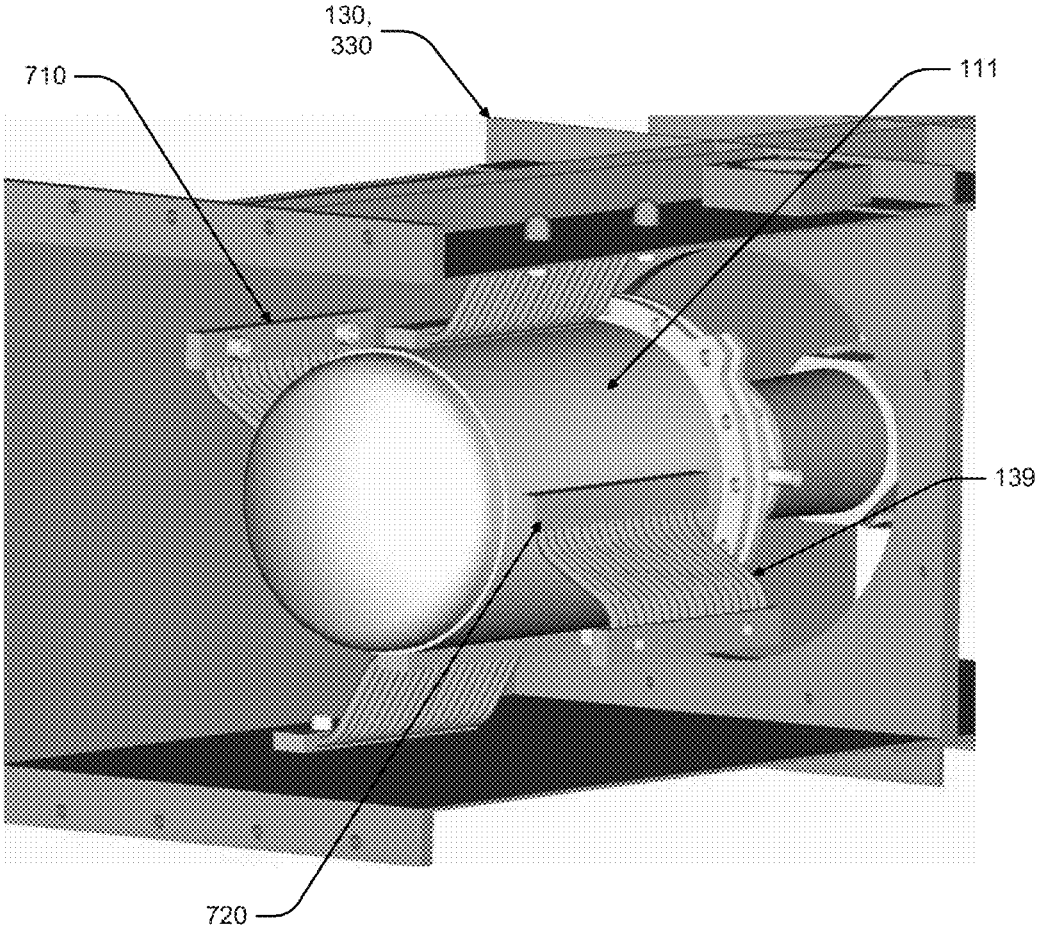
FIG. 7 illustrates a Stirling convertor and a plurality of thermal straps, in accordance with various aspects of the subject technology.

In some aspects, to further reduce the temperature of the alternator, a plurality of thermal straps 139 may be utilized to transfer the excess thermal energy from each of the Stirling convertors 111 to the housing 130, 330. Referring to FIG. 7, the plurality of thermal straps 139 may comprise four thermally conductive straps per Stirling convertor 111, configured to transfer the excess thermal energy directly to the housing 130, 330 by conduction rather than by radiation. The thermal straps 139 may, for example, comprise graphite fiber thermal straps having a conductance of about 0.6 W/° C. Each thermal strap 139 may consist of a series of flexible thermally conductive bundles arranged in a substantially planar configuration and may, for example, comprise about 37 bundles.

In one aspect, a first end of each of the plurality of thermal straps 139 may be thermally coupled to an inside surface of the housing 130, 330. For example, the first end of the thermal strap 139 may comprise a mount 710 made from Aluminum and configured with a plurality of mounting holes for enabling a bolted engagement with the housing 130, 330.

In another aspect, a second end of each of the plurality of thermal straps 139 may be thermally coupled to an outer surface of the Stirling convertor 111. For example, the second end of the thermal strap 139 may comprise a mount 720 made from Aluminum and configured to be bonded to the outer surface of the Stirling convertor 111.

In some aspects, the thermal straps 139 may greatly reduce the temperature of the alternator. As shown in Table 7, the average temperature of the alternator decreased by 82° C. in comparison of the alternator temperature shown in Table 3.

TABLE 7

| Component | Average Temperature |
|---|---|
| Heat Collector | 797° C. |
| Cold Side Adaptor Flange | 82° C. |
| Alternator | 55° C. |
| Housing | 44° C. |
| Radiator Fins | 33° C. |
| Controller | 24° C. |

In some aspects, if the number of GPHS modules 125 is greater than two per Stirling convertor 111, the thermal straps 139 may be used to maintain a temperature of the alternator that is below the upper operating temperature limit of the alternator.

Figure 8:
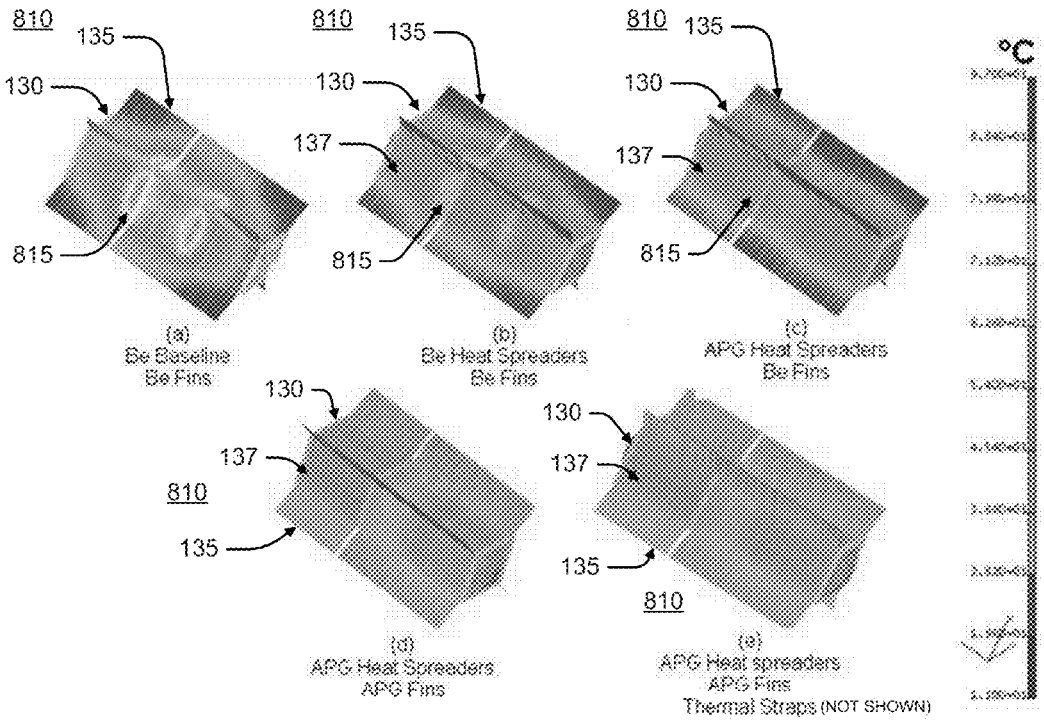
FIG. 8 illustrates a temperature distribution of an extended performance Stirling radioisotope generator, in accordance with various aspects of the subject technology.

In some aspects, referring to FIG. 8, the performance of the generator 810 may be improved by efficiently distributing the excess thermal energy throughout the housing 130. For example, by using the heat spreaders 137 formed of APG instead of Beryllium, the performance of the generator 810 may be improved. Referring to FIG. 8*a*, the generator 810 having the housing 130, plurality of radiator fins 135, and plurality of heat spreaders 137 formed of Beryllium, may have a nominal power output of about 285 $W_{dc}$ at a heat sink temperature of −269° C., have a mass of about 33 kg and a specific power of about 8.6 $W_{dc}$/kg. In comparison, referring to FIG. 8*b*, the generator 810 having the housing 130 and plurality of radiator fins 135 formed of Beryllium, and having the plurality of heat spreaders 137 formed of APG, may have a nominal power output of about 292 $W_{dc}$ at a heat sink temperature of −269° C., have a mass of about 34.5 kg and a specific power of about 8.5 $W_{dc}$/kg. Although the specific power slightly decreased due to the APG heat spreaders being slightly heavier than the Beryllium heat spreaders, the nominal power output increased from 285 $W_{dc}$ to 292 $W_{dc}$.

In further comparison, referring to FIG. 8*c*, the generator 810 having the housing 130 formed of Beryllium, and having the plurality of radiator fins 135 and heat spreaders 137 formed of APG, may have a nominal power output of about 295 $W_{dc}$ at a heat sink temperature of −269° C., have a mass of about 34.8 and a specific power of about 8.5 $W_{dc}$/kg. The nominal power output of the generator 810 therefore increased from 285 $W_{dc}$ to 295 $W_{dc}$ due to the APG radiator fins and heat spreaders.

In further comparison, referring to FIG. 8*d*, the generator 810 having the housing 130 formed of Beryllium, the plurality of radiator fins 135 and heat spreaders 137 formed of APG, and having thermal straps 139 (not shown) may have a nominal power output of about 297 $W_{dc}$ at a heat sink temperature of −269° C., have a mass of about 35.3 and a specific power of about 8.4 $W_{dc}$/kg. The nominal power output of the generator 810 therefore increased from 285 $W_{dc}$ to 297 $W_{dc}$ due to the thermal straps and the APG radiator fins and heat spreaders.

Figure 9:
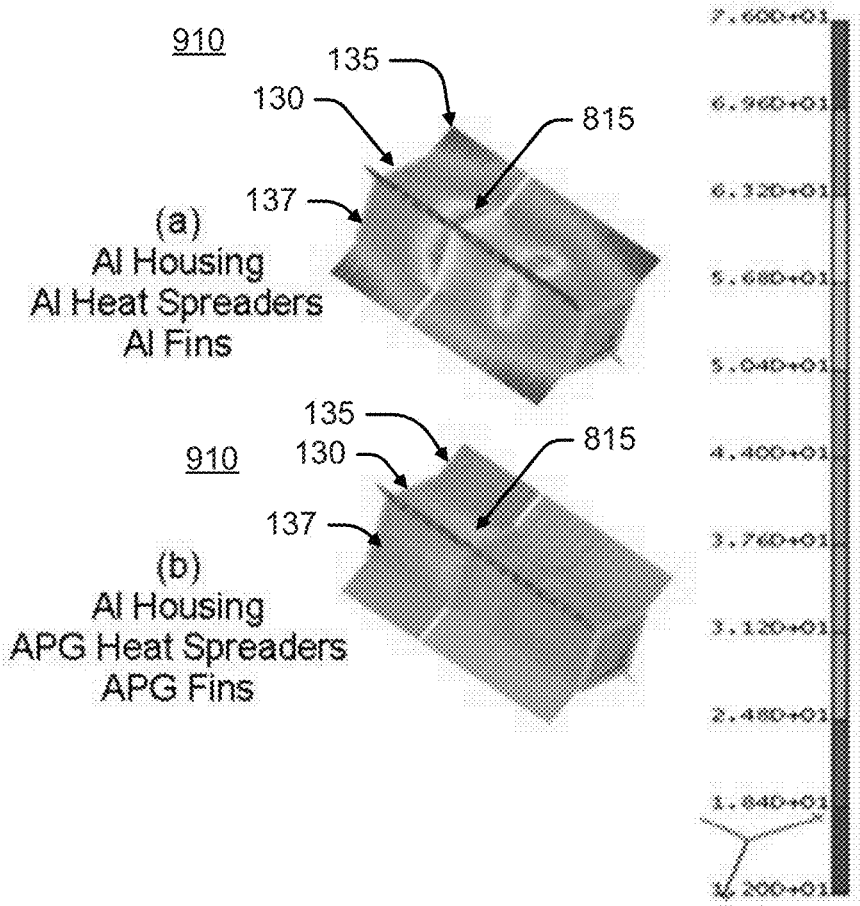
FIG. 9 illustrates a temperature distribution of an extended performance Stirling radioisotope generator, in accordance with various aspects of the subject technology.

In some aspects, as discussed above, the housing 130, 330 may be formed of Aluminum. Referring to FIG. 9*a*, a temperature distribution of an extended performance Stirling radioisotope generator 910 is illustrated. Generator 910 is configured with two GPHS modules per Stirling convertor. Generator 910 may have a housing 130, plurality of radiator fins 135, and plurality of heat spreaders 135 all formed from Aluminum. In one aspect, because Aluminum may have a similar thermal conductivity as Beryllium, a temperature distribution of the excess thermal energy by the generator 910 may be similar to a temperature distribution of the excess thermal energy by the generator 810 formed from Beryllium, as shown in FIG. 8*a*.

Referring to FIG. 9*a*, the excess thermal energy from the GPHS modules and/or the Stirling convertor may not be uniformly distributed throughout the housing 130, as indicated by the high temperature gradient surrounding an interface area 815. Consequently, the housing 130 and the plurality of radiator fins 135 may be dissipating the excess thermal energy ineffectively. The average temperature of the heat collector 117 (not shown), CSAF 113 (not shown), alternator (not shown), housing 130, plurality of radiator fins 135, and controller (not shown) for the generator 910 of FIG. 9*a*, are provided in Table 8.

TABLE 8

| Component | Average Temperature |
|---|---|
| Heat Collector | 800° C. |
| Cold Side Adaptor Flange | 107° C. |
| Alternator | 119° C. |
| Housing | 53° C. |
| Radiator Fins | 32° C. |
| Controller | 31° C. |

In one aspect, the nominal power output and specific power for the generator 910, having the housing 130, radiator fins 135, and heat spreaders 137 all formed from Aluminum, may be increased by using radiator fins and heat spreaders formed of APG. Referring to FIG. 9*a*, the generator 910 may have a nominal power output of about 284 $W_{dc}$ at a heat sink temperature of −269° C., have a mass of about 38.2 kg and a specific power of about 7.4 $W_{dc}$/kg. In comparison, referring to FIG. 9*b*, the generator 910 having the housing 130 formed of Aluminum and the plurality of radiator fins 135 and plurality of heat spreaders 137 formed from APG, may have a nominal power output of about 295 $W_{dc}$ at a heat sink temperature of −269° C., have a mass of about 37.5 and a specific power of about 7.9 $W_{dc}$/kg. The nominal power output of the generator 910 therefore increased from 284 $W_{dc}$ to 295 $W_{dc}$ and the specific power increased from 7.4 $W_{dc}$/kg to 7.9 $W_{dc}$/kg due to the APG radiator fins and heat spreaders.

In another aspect, by using radiator fins 135 and heat spreaders 137 formed of APG, the generator 910 having the housing 130 formed from Aluminum may have an improved temperature distribution of the excess thermal energy. As indicated by FIG. 9*b*, the generator 910 may have a reduced temperature gradient surrounding the interface area 815. Consequently, the housing 130 and the plurality of radiator fins 135 may dissipate the excess thermal energy more effectively. As shown in Table 9, the average temperature of the alternator decreased by 18° C. in comparison of the alternator temperature shown in Table 8.

TABLE 9

| Component | Average Temperature |
|---|---|
| Heat Collector | 798° C. |
| Cold Side Adaptor Flange | 87° C. |
| Alternator | 101° C. |
| Housing | 44° C. |
| Radiator Fins | 34° C. |
| Controller | 25° C. |

In various aspects of the subject technology, to increase the specific power for an Aluminum housing, the mass of the housing may be reduced by using the MLI to reduce the cross section of the housing. For example, referring to FIGS. 4-6, the generators 300, 400, 500 may utilize the MLI 131 to reduce the cross section of the housing 330. Accordingly, as discussed above, the cross section of the housing may be modified and reduced from a square-shaped cross section having a height (H) of about 8.8 inches (as shown in FIGS. 2 and 3), to a round-shaped cross section having a diameter (H) of about 6.9 inches (as shown in FIGS. 4-6).

Referring to FIG. 4, the generator 300, having two GPHS modules 125 per Stirling convertor 111, has a housing 330 with a round cross section, thereby reducing the mass of the Aluminum housing 330 and providing a specific power of about 9.4 $W_{dc}$/kg.

Referring to FIG. 5, the generator 400, having three GPHS modules 125 per Stirling convertor 111, has a housing 330 with a round cross section, thereby reducing the mass of the Aluminum housing 330 and providing a specific power of about 10 $W_{dc}$/kg.

Referring to FIG. 6, the generator 500, having four GPHS modules 125 per Stirling convertor 111, has a housing 330 with a round cross section, thereby reducing the mass of the Aluminum housing 330 and providing a specific power of about 11 $W_{dc}$/kg.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It should be understood that the specific order or hierarchy of steps in the processes disclosed is an illustration of exemplary approaches. Based upon design preferences, it should be understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A Stirling radioisotope generator comprising:

a first and second heat source assembly, each heat source assembly comprising two General Purpose Heat Source modules, each General Purpose Heat Source module configured to generate thermal energy;

a first and second Stirling convertor in thermal communication with the first and second heat source assembly, respectively, each Stirling convertor configured to convert the thermal energy into electrical power;

a housing enclosing the first and second heat source assembly and the first and second Stirling convertor, the housing configured to dissipate excess thermal energy; and a plurality of thermal straps configured to transfer excess thermal energy from the first Stirling convertor to the housing, wherein, for at least one thermal strap of the plurality of thermal straps, a first end of the at least one thermal strap is coupled to an inside surface of the housing and a second end of the at least one thermal strap is coupled to an outer surface of the first Stirling convertor.

2. The generator of claim 1, wherein the generator is configured to generate a nominal power output of about 300 Wdc.

3. The generator of claim 1, wherein the generator has a specific power greater than 8 Wdc/kg.

4. The generator of claim 1, wherein the housing has a round cross section.

5. The generator of claim 1, wherein the generator further comprises a plurality of radiator fins comprising annealed pyrolytic graphite and configured to dissipate the excess thermal energy, the plurality of radiator fins disposed along a length of the housing.

6. The generator of claim 1, wherein the generator further comprises a plurality of heat spreaders comprising annealed pyrolytic graphite and configured to distribute the excess thermal energy, the plurality of heat spreaders disposed on a surface of the housing.

7. The generator of claim 1, wherein the generator further comprises another plurality of thermal straps configured to transfer excess thermal energy from the second Stirling convertor to the housing.

8. The generator of claim 1, wherein the generator further comprises multilayer insulation comprising an end cap disposed at an end of the first heat source assembly.

9. The generator of claim 1, wherein, for the at least one thermal strap, the first end comprises a mount coupled to the inner surface of the housing and the second end comprises a mount coupled to the outer surface of the first Stirling convertor.

10. The generator of claim 1, wherein each thermal strap of the plurality of thermal straps is flexible.

11. The generator of claim 1, wherein each thermal strap of the plurality of thermal straps comprises flexible thermally conductive bundles.

12. A Stirling radioisotope generator comprising:

a first and second heat source assembly, each heat source assembly comprising three General Purpose Heat Source modules, each General Purpose Heat Source module configured to generate thermal energy;

a first and second Stirling convertor in thermal communication with the first and second heat source assembly, respectively, each Stirling convertor configured to convert the thermal energy into electrical power;

a housing enclosing the first and second heat source assembly and the first and second Stirling convertor; the housing configured to dissipate excess thermal energy; and a plurality of thermal straps configured to transfer excess thermal energy from the first Stirling convertor to the housing, wherein, for at least one thermal strap of the plurality of thermal straps, a first end of the at least one thermal strap is coupled to an inside surface of the housing and a second end of the at least one thermal strap is coupled to an outer surface of the first Stirling convertor.

13. The generator of claim 12, wherein the generator is configured to generate a nominal power output of about 450 Wdc.

14. The generator of claim 12, wherein the generator has a specific power greater than 8 Wdc/kg.

15. The generator of claim 12, wherein the housing has a round cross section.

16. The generator of claim 12, wherein the generator further comprises a plurality of radiator fins comprising annealed pyrolytic graphite and configured to dissipate the excess thermal energy, the plurality of radiator fins disposed along a length of the housing.

17. The generator of claim 12, wherein the generator further comprises a plurality of heat spreaders comprising annealed pyrolytic graphite and configured to distribute the excess thermal energy, the plurality of heat spreaders disposed on a surface of the housing.

18. The generator of claim 12, wherein the generator further comprises another plurality of thermal straps configured to transfer excess thermal energy from the second Stirling convertor to the housing.

19. The generator of claim 12, wherein the generator further comprises a heat shunt configured to divert the thermal energy of the General Purpose Heat Source modules from the first heat source assembly to the first Stirling convertor.

20. The generator of claim 12, wherein the generator further comprises multilayer insulation comprising an end cap disposed at an end of the first heat source assembly.

21. A Stirling radioisotope generator comprising:

a first and second heat source assembly, each heat source assembly comprising four General Purpose Heat Source modules, each General Purpose Heat Source module configured to generate thermal energy;

a first and second Stirling convertor in thermal communication with the first and second heat source assembly, respectively, each Stirling convertor configured to convert the thermal energy into electrical power;

a housing enclosing the first and second heat source assembly and the first and second Stirling convertor; the housing configured to dissipate excess thermal energy; and a plurality of thermal straps configured to transfer excess thermal energy from the first Stirling convertor to the housing, wherein, for at least one thermal strap of the plurality of thermal straps, a first end of the at least one thermal strap is coupled to an inside surface of the housing and a second end of the at least one thermal strap is coupled to an outer surface of the first Stirling convertor.

22. The generator of claim 21, wherein the generator is configured to generate a nominal power output of about 600 Wdc.

23. The generator of claim 21, wherein the generator has a specific power greater than 8 Wdc/kg.

24. The generator of claim 21, wherein the housing has a round cross section.

25. The generator of claim 21, wherein the generator further comprises a plurality of radiator fins comprising annealed pyrolytic graphite and configured to dissipate the excess thermal energy, the plurality of radiator fins disposed along a length of the housing.

26. The generator of claim 21, wherein the generator further comprises a plurality of heat spreaders comprising annealed pyrolytic graphite and configured to distribute the excess thermal energy, the plurality of heat spreaders disposed on a surface of the housing.

27. The generator of claim 21, wherein the generator further comprises another plurality of thermal straps configured to transfer excess thermal energy from the second Stirling convertor to the housing.

28. The generator of claim 21, wherein the generator further comprises a heat shunt configured to divert the thermal energy of the General Purpose Heat Source modules from the first heat source assembly to the first Stirling convertor.

29. The generator of claim 21, wherein the generator further comprises multilayer insulation comprising an end cap disposed at an end of the first heat source assembly.

* * * * *